US007731554B2

(12) United States Patent
Grune

(10) Patent No.: US 7,731,554 B2
(45) Date of Patent: Jun. 8, 2010

(54) WAVE-RIDING VEHICLE WITH SHARK LOCATING AND REPELLING SYSTEM

(76) Inventor: Guerry L. Grune, 784 S. Villier Ct., Virginia Beach, VA (US) 23452

( * ) Notice: Subject to any disclaimer, the term of this patent is extended or adjusted under 35 U.S.C. 154(b) by 0 days.

(21) Appl. No.: 12/322,687

(22) Filed: Feb. 5, 2009

(65) Prior Publication Data

US 2009/0142976 A1 Jun. 4, 2009

Related U.S. Application Data

(63) Continuation of application No. 10/710,079, filed on Jun. 17, 2004, now Pat. No. 7,507,132.

(60) Provisional application No. 60/499,028, filed on Aug. 28, 2003.

(51) Int. Cl.

| | |
|---|---|
| ***B63B 35/79*** | (2006.01) |
| ***A01M 29/00*** | (2006.01) |
| ***H05C 1/00*** | (2006.01) |
| *B63C 11/49* | (2006.01) |

(52) U.S. Cl. ..... 441/65; 441/74; 441/80; 119/220; 367/139

(58) Field of Classification Search ..... 441/65–79, 441/80, 135; 116/22 A; 119/219, 220; 367/139
See application file for complete search history.

(56) References Cited

U.S. PATENT DOCUMENTS

| | | | | |
|---|---|---|---|---|
| 3,822,403 | A * | 7/1974 | Coleman et al. | 455/40 |
| 4,081,783 | A * | 3/1978 | Honda | 367/101 |
| 4,211,980 | A * | 7/1980 | Stowell | 455/40 |
| 5,260,912 | A * | 11/1993 | Latham | 367/88 |
| 5,570,322 | A * | 10/1996 | Miller | 367/107 |
| 7,037,153 | B1 * | 5/2006 | Wynne | 441/74 |
| 7,145,835 | B2 * | 12/2006 | Pope | 367/131 |
| 7,507,132 | B2 * | 3/2009 | Grune et al. | 441/65 |
| 2006/0016379 | A1 * | 1/2006 | Wescombe-Down | 114/221 R |

* cited by examiner

*Primary Examiner*—Ajay Vasudeva
(74) *Attorney, Agent, or Firm*—Guerry L. Grune, ePatentmanager

(57) ABSTRACT

A shark-repelling surfboard or flotation board made of polymer foam with coating. The surfboard or the flotation board has a locator device for locating large aquatic animals, and an alarm device for alerting a rider of large aquatic animals, such as sharks, located by the locator device. The surfboard or the flotation board also comprises a repellent or deterrent signal generator that is configured for transmitting interference signals to disrupt the electro-sensory perception system of the aquatic animals.

14 Claims, 3 Drawing Sheets

WAVE-RIDING VEHICLE WITH SHARK LOCATING AND REPELLING SYSTEM

CLAIM TO PRIORITY

This application is a continuation of Ser. No. 10/710,079 filed on Jun. 17, 2004, now U.S. Pat. No. 7,507,132.

Applicants hereby claim priority under all rights to which they are entitled under 35 U.S.C. 120 based upon application Ser. No. 10/710,079, filed 17 Jun. 2004 and 35 U.S.C. 119(e) based upon the U.S. Provisional Application Ser. No. 60/499,028 filed 28 Aug. 2003.

BACKGROUND OF THE INVENTION

1. Field of Invention

This invention relates to a transparent wave riding vehicle. More specifically, the present invention also relates to a transparent surfboard with an optional embedded or surface mounted locator and alarm for large aquatic animals, specifically prepared to identify such animals as sharks, and an optional shark-resistant signal generator that transmits an interference signal to interrupt the electrical signals used by aquatic animals for electrical sense. More specifically these aquatic animals maybe greater than three feet in length (such as a shark) and within at least a specified radius of the wave riding vehicle with regard to the sensory perception of a shark, thus diverting or distracting it from a surfer. The wave riding vehicle may include surfboards, wind surf-boards, kite surfboards, knee boards, boogie boards, as well as jet skis and the like.

2. Relevant Art

The incorporation of unique features on or pertaining to a surfboard is well known in the prior art. Such prior art includes, for example, a hydrofoil surfboard (U.S. Pat. No. 3,747,138), a steerable surfboard (U.S. Pat. No. 4,389,195), a foldable water sports board (WO 00/24631), a travel surfboard (U.S. Pat. No. 6,241,568), and a motor-driven surfboard (U.S. Pat. No. 6,142,840). No known invention exists, however, describing a surfboard which is fully transparent, allowing one to see clearly and completely through the surfboard in its entirety. Additionally, no known invention exists describing methods or devices for controlling or deterring sharks in combination with the use of a surfboard or other aquatic sports devices used where sharks or other predatory marine animals harmful to humans may be present.

U.S. Pat. Des. 377,072, Surfboard with Transparent Window, published Dec. 13, 1996, describes a design in which a surfboard has a small transparent window that is rectangular or oval in shape. The transparent portion of the surfboard in this design patent, located in the front center of the board, is only a small portion of the entire board surface area. The present invention describes a surfboard that is transparent in its entirety. No documentation is known in which a completely transparent surfboard is described.

To be fully transparent, all parts of a surfboard must be transparent—both the foam blank which forms the center or core of the surfboard and the epoxy or other polymeric coating which is covers the blank to form the outer surface of the surfboard. There are in existence clear epoxies and other polymers that can be spread over a foam blank, but clear foam blanks themselves do not exist. The following two patents, each incorporated herein by reference, discuss and describe existing methods to develop and manufacture transparent foam. It is an embodiment of the present invention to use such foam in the manufacturing process that forms the foam blank which constitutes the core of a surfboard. A clear epoxy or other transparent polymer can then be used to cover the clear foam blank, thus creating a fully transparent surfboard.

U.S. Pat. No. 6,555,589, entitled Transparent Supermicrocellular Polymer Foams and Method for Their Manufacture, which was granted Apr. 29, 2003, describes a novel class of transparent polymeric foams comprising submicron cells and a process for their production. This patent further describes polymers that are preferably high glass transition materials and the process comprises saturating a consolidated polymer shape with an inert gas at a temperature above the glass transition temperature of the polymer and under a pressure of at least 9000 psi for a period adequate to dissolve the gas in the polymer shape and then controllably cooling the polymer shape to produce the submicron cell structure. These novel polymeric foams, because of their sub-micron or even nano-size of their component bubbles, are transparent and demonstrate enhanced optical properties.

U.S. Pat. No. 6,555,590, entitled Transparent Super-microcellular Polymer Foams from High $T_g$ Polymers and Method for Manufacture, by the same inventor on the patent cited immediately above, granted Apr. 29, 2003, describes a novel class of transparent polymeric foams from high $T_g$ polymers comprising submicron cells and a process for their production. This patent similarly describes novel polymer foams that are transparent and a method for their manufacture.

In addition to the transparency of the surfboard or wave riding vehicle in the present invention, which alone aids the surfer, swimmer, or diver in shark detection simply based on increased visibility, the surfboard also contains a shark-resistant signal generator. Shark attack is a long-recognized hazard that must be considered by surfers, divers, and swimmers in marine waters. In fact much concern exists about all marine elasmobranches (sharks, skates, and rays) and their potential dangers.

Addressing this concern regarding the danger of sharks, much prior art exists describing methods in which sharks are repelled, deterred, destroyed, etc. by electrical, mechanical, and chemical methods each designed to aid a surfer, diver, or swimmer.

The following patents provide existing methods and devices to control aquatic animals, particularly sharks, using electrical or electro-magnetic techniques.

U.S. Pat. No. 5,566,643, entitled 'Control of Sharks', which was granted Oct. 22, 1996, describes a method and apparatus for controlling sharks and other aquatic animals. The method uses electrodes that are immersed in a body of water to create an electric field by applying electrical pulses. The pulses may have a duration of between 0.1 and 200 ms, a repetition rate of between 1 and 60 Hz, and a field strength of 1 to 10 $V \cdot m^{-1}$ in the body of water at a distance of 1 m from the electrodes. Such apparatus acts to repel aquatic animals from the vicinity of the electrodes. The patent states that in a preferred form of the invention, the pulses are generated in pulse trains each comprising a plurality of pulses, with each pulse having a duration of between 0.1 and 3 ms, the pulses in each train being spaced at intervals of between 1 and 30 ms, and the pulse trains being repeated at intervals of between 100 and 1000 ms. The patent further states that in a specific form of the invention, each pulse in such a pulse train has a duration of 2 ms, the pulses in each train are spaced at intervals of 20 ms and the pulse trains are repeated at a frequency of between 2 and 5 Hz.

U.S. Pat. No. 3,683,280, entitled Shark Repelling Device Including Pulse Generator Producing Electrical Field in Water between Widely Spaced Electrodes, which was granted published Aug. 8, 1972, is based on the repeated charging and discharging of a capacitor to establish an electric field in a body of water. This invention is primarily concerned with aiding the fishing industry and is used alongside fishing nets to prevent sharks from entering the open mouths of nets drawn by trawlers, so as to preserve the catch in the nets from devastation by sharks. The invention is, nonetheless, an electrical pulse generator concept designed for the control of sharks.

U.S. Pat. No. 4,211,980, entitled Method of Creating an Electric Field for Shark Repellent, which was granted Jul. 8, 1980, describes a method for repelling sharks and the like by creating an electric field containing a zone about an anode and/or cathode electrodes submersed in salt water. The patent further describes a voltage gradient of sufficient magnitude to overstimulate the nervous system of a shark yet which is insufficient to disturb most scaled fish and man. The electric field created is maintained only long enough to allow nerve cell response in a shark. It is turned on with a frequency near a shark's nervous system's normal frequency.

U.S. Pat. No. 3,822,403, entitled Apparatus and Method for Repelling Sharks and the Like, which was granted Jul. 2, 1974, describes an apparatus and method for electromagnetically repelling elasmobranches, such as sharks and the like, where an electric circuit, including a timing circuit, a plurality of spaced electrodes and a source of electrical energy, is connected in a housing and is energized upon submergence of electrodes in a body of water, the electric circuit including means for rapidly pulsing a direct current between the electrodes to generate an electromagnetic field in the body of water to repel sharks and the like.

U.S. Pat. No. 4,825,810, entitled Electric Barrier for Fish, which was granted May 2, 1989, describes a fish barrier to prevent passage there past of fish is established by applying alternating asymmetrical pulses across water immersed anode and cathode electrodes, where the cathode electrode represents the barrier. A higher voltage negative pulse produces a direct current field in a first zone adjacent the cathode electrode which zone is sensed by the fish at a threshold value of field intensity. The first zone induces a neuromuscular twitch response to turn the fish away from the negative electrode. A lower voltage positive pulse produces an alternating current field in a second zone closer to the cathode electrode, which zone is sensed only by those fish in close proximity to the cathode electrode. The second zone induces muscular contraction followed by tetany and usually death. By placing the cathode electrode across a stream or canal to prevent upstream fish movement, most of the fish will be involuntarily prevented from swimming close to the barrier. The dying and dead fish which did swim too close to the cathode electrode will be carried downstream and away from the barrier by the water flow. The use of alternating pulses of essentially equal energy level prevents degradation of the field intensity by preventing a build-up of metallic oxides on the cathode electrode due to electrolysis.

U.S. Pat. No. 4,879,833, entitled Shark Diverting Apparatus, which was granted Nov. 14, 1989, describes a shark diverting apparatus in which a signal generator is used to attract sharks and further uses the release of air pressure to create air bubbles to draw sharks away from and below an individual, thus protecting a person in marine waters from shark attack.

Although each of these inventions may be useful in the scope of their limited design, further means are necessary to adequately protect a surfer, swimmer, or diver from possible shark attack.

Additionally there are means by which a shark or other elasmobranch may be controlled or deterred without the use of large electrical or electro-magnetical fields. The following patents discuss existing methods and devices to control aquatic animals, particularly sharks, using techniques that are or resemble an underwater firearm. Previous inventions include an underwater repeating shotgun (U.S. Pat. No. 3,721,031) specifically designed to fire against a shark, a shark prod (U.S. Pat. No. 4,667,431) whereby a shark is repelled by electrically conductive prongs upon impact with the device, a shark protecting device (U.S. Pat. No. 4,451,194) whereby a probe must be armed by the swimmer and the probe contains a dart that, once launched, enters a shark's body causing bloating and the inability to maneuver, and an underwater protection device (U.S. Pat. No. 4,100,692) whereby a cylindrical barrel carries a firearm shell which detonates upon contact of a shark or like animal and the barrel itself.

These inventions of course will likely destroy or severely harm the shark. The present invention is primarily directed with deterring the shark such that a surfer is protected from shark attack. In addition, these inventions require much intervention by the surfer, swimmer, or diver. Additionally the devices described in the art would be difficult, if not impossible, to operate while in the process of surfing. The present invention is different in that it does not require intensive participation.

There are still further examples of art in which the control of sharks or like animals is concerned. The following patents discuss existing methods and devices to control aquatic animals, particularly sharks, using techniques that essentially surround a person by a protective barrier. Such prior art includes a shark screen (U.S. Pat. No. 3,986,220) in which a survivor of a shipwreck has increased protection from shark attack by means of a vacuum-packed screen that unfolds to fully surround one floating in the water. Another invention also includes a waterborne life-saving apparatus (U.S. Pat. No. 4,223,415) in which a buoyant raft includes a bag which surrounds the underwater side of the raft and protects the persons contained within from shark attack. These inventions are more likely to be used in a life-saving event such as after a plane crash over marine waters or a boat wreck.

There are additional examples of art in which the control of sharks or like animals is concerned. The following patent discusses an existing method and device to protect a person in marine waters from a shark. Prior inventions include a shark protector suit (U.S. Pat. No. 4,833,729) in which a person wears a rubber suit and helmet which is covered with a plurality of long spikes. Such an invention would not be well-suited for a surfer or recreational swimmer in marine waters.

There are still further examples of art in which the control of sharks is concerned. The following patents discuss existing methods and devices to control aquatic animals, particularly sharks, using techniques that are more chemical in nature. Earlier inventions exist describing a shark-repellant patch (U.S. Pat. No. 5,407,679 and U.S. Pat. No. 5,616,333) in which a patch is worn by a person or in which a patch is placed on an object. Such patch includes an impermeable membrane containing a shark repelling substance that upon bite or attack by shark ruptures and thus deters the shark. This invention presumes that the wearer of such a patch can withstand even the initial contact that would then release the shark-repelling substance into the waters. This invention may perhaps deter a shark attack once in progress, but it offers little in the way of prevention of the initial attack of the shark.

In addition to the transparency of the surfboard or other wave riding vehicle in the present invention and the associated shark-resistant signal generator, this invention also describes a component of the device in which aquatic animals that are about three feet in length (such as a shark) and within about a one-hundred foot radius of the surfboard can be identified by location. The following patents discuss existing methods and devices to identify or locate fish or other aquatic animals and are incorporated by reference herein.

U.S. Pat. No. 5,296,912, entitled Side-Looking Fish Finder, which was granted Nov. 9, 1993, describes a side-looking fish finding apparatus that transmits a sonar pulse approximately horizontally into a body of water, and then monitors echoes from the pulse. This invention and the U.S. Pat. No. 5,296,912 is incorporated by reference herein. Such a device is useful to a surfer who needs to know not only what large aquatic animals are beneath but also needs to know what large aquatic animals are within a certain horizontal radius of the surfboard. The patent further describes the echo device to be sensitive such that an individual echo is treated as the detection of a fish if it has a magnitude above a predetermined threshold. Additionally, the device is sensitive if the fish has a length within a predetermined range bounded by upper and lower limits.

U.S. Pat. No. 5,926,438, entitled Hand-Held LCD Fish Finder, is incorporated by reference herein. This patent describes a hand-held LCD game machine used as a hand-held LCD fish finder. This patent is incorporated by reference herein and provides the availability, portability, and compactness of such a fish-finder type device. This type of device may be used by embedding the device within the shark-safe surfboard described in the present invention.

U.S. Pat. No. 4,081,783, entitled Fish Finder Capable of Discriminating Sizes of Fish, which was granted Mar. 28, 1978, is incorporated by reference herein. This patent describes a fish finder wherein one transducer is used to generate both high- and low-frequency ultrasonic waves which are simultaneously emitted and the electrical signal representative of the reflected high- or low-frequency ultrasonic waves is extracted by the signal representative of the reflected low- or high-frequency ultrasonic waves, thereby discriminating the sizes of fish detected. This invention is particularly useful to the present invention because a surfer need not be informed of all aquatic animals in the immediate vicinity. A surfer need only be made aware of large predatory aquatic animals that are at least a certain size in length, such as a shark, that may cause harm and this patent describes an invention which is easily incorporate into the body of a surfboard.

U.S. Pat. No. 4,104,609, entitled Fish Finder, which was granted Aug. 1, 1978, describes a fish-finder of the type emitting ultrasonic pulses into the water and receiving and displaying the reflected waves, the received reflected waves are converted into digital signals corresponding to their levels and written into a main memory as information of one display line of a color cathode ray tube display. The main memory has a capacity of storing information of one picture frame of the color cathode ray tube display, and is read out repeatedly. The read-out signals are converted into color signals according to their levels and the color signals are supplied to the color cathode ray tube. Every time a new reflected wave is written into the main memory, the stored content of the main memory is partly removed so that the oldest display on the screen may disappear and, at the same time, the display on each display line is shifted to the older display line. This invention and U.S. Pat. No. 4,104,609 is incorporated by reference herein. The use of color in this invention would be helpful to a surfer who needs to be able to easily read the display and be informed of a nearby shark, especially in conjunction with an otherwise transparent surfboard.

Additional art exists describing a fish finder (U.S. Pat. No. 5,594,707) that discloses the condition of the water bottom and displays obstacles that might interfere with a boat. Design patents also exists for fish finders (U.S. D 459,250 and U.S. D 398,546), each suggesting ornamental designs of fish finders. These design patents suggest the potential compactness of such a device, as would be necessary for the incorporation into a surfboard.

It is an object of the present invention to address all of the above-mentioned concerns regarding protection of a surfer, swimmer, or diver from shark attack. While each of the above mentioned embodiments is each useful in its own right and limited scope, none suggest a comprehensive solution for a surfer, swimmer, or diver to be protected from shark attack by means of a transparent surfboard, shark resistant signal-generator and alarm, and locator of large aquatic animals.

The present invention is partially based on recognition of the electrical sensory perception of elasmobranches. The following science journal articles discuss electro-sensory capabilities of sharks.

One article of significance is "Electrical Characterization of Gel Collected from Shark Electro-sensors," by Brandon R. Brown et al. published in *Physical Review E*, Volume 65, 061903, Jun. 12, 2002. These article states, "To investigate the physical mechanism of the electric sense, we present an initial electrical characterization of the glycoprotein gel that fills the electro sensitive organs of marine elasmobranches sharks, skates, and rays. We have collected samples of this gel, postmortem, from three shark species, and removed the majority of dissolved salts in one sample via dialysis. Here we present the results of dc conductivity measurements, low-frequency impedance spectroscopy, and electrophoresis. Electrophoresis shows a range of large protein-based molecules fitting the expectations of glycoprotein, but the gels of different species exhibit little similarity. The electrophoresis signature is unaffected by thermal cycling and measurement currents. The dc data were collected at various temperatures, and at various electric and magnetic fields, showing consistency with the properties of seawater. The impedance data collected from a dialyzed sample, however, show large values of static permittivity and a loss peak corresponding to an unusually long relaxation time, about 1 ms. The exact role of the gel is still unknown, but results suggest its bulk properties are well matched to the sensing mechanism, as the minimum response time of an entire electric organ is on the order of 5 ms."

Another article of significance is "Modeling an Electro sensory Landscape: Behavioral and Morphological Optimization in Elasmobranches Prey Capture," by Brandon Brown, which was published in *The Journal of Experimental Biology* 205, 999 1009 (2002). This article states, "Most biological sensory systems benefit from multiple sensors. Elasmobranches (sharks, skates and rays) possess an array of electro receptive organs that facilitate prey location, mate location and navigation. Here, the perceived electro sensory landscape for an elasmobranches approaching prey is mathematically modeled. The voltages that develop simultaneously in dozens of separate sensing organs are calculated using electrodynamics. These voltages lead directly to firing rate modifications in the primary afferent nerves. The canals connecting the sense organs to an elasmobranches surface exhibit great variation of location and orientation. Here, the voltages arising in the sense organs are found to depend strongly on the geometrical distribution of the corresponding canals. Two applications for the modeling technique are explored: an analysis of observed elasmobranches prey-capture behavior and an analysis of morphological optimization. For the former, results in specific predator-prey scenarios are compared with behavioral observations, supporting the approach algorithm suggested by A. Kalian. For the latter, electro sensory performance is contrasted for two geometrical models of multiple sense organs, a rounded head and a hammer-shaped head."

SUMMARY OF INVENTION

The present invention includes three features which aid the surfer or wave rider, or swimmer, diver, or water bather in avoiding a shark attack. The transparent surfboard or other wave riding vehicle itself, that enables one to see what is directly below or around at all times, an optional locator and alarm embedded within or on the surface of the surfboard or wave-riding vehicle itself that locates aquatic animals about three feet in length and within about a one hundred foot radius of the surfboard, and an optional signal generator that transmits a signal at a less-than-one-kilohertz frequency to interrupt the electrical sensory perception of a shark and thus divert a shark from the wave or water rider are all part of the invention. Each of the novel surfboard or wave riding vehicle features including; transparency, locator and alarm, and the low frequency signal generator will provide a measure of safety for the surfer, diver, or swimmer that is either using the surfboard or wave riding vehicle or has the surfboard or other vehicle in close proximity while in the ocean. The wave riding vehicle of the present invention may include surfboards for surfing, wind surf-boards for wind surfing, kite surfboards for kite surfing, knee boards for knee boarding, and boogie boards for belly boarding, as well as jet skis and the like.

DETAILED DESCRIPTION OF THE INVENTION

Figure 1:
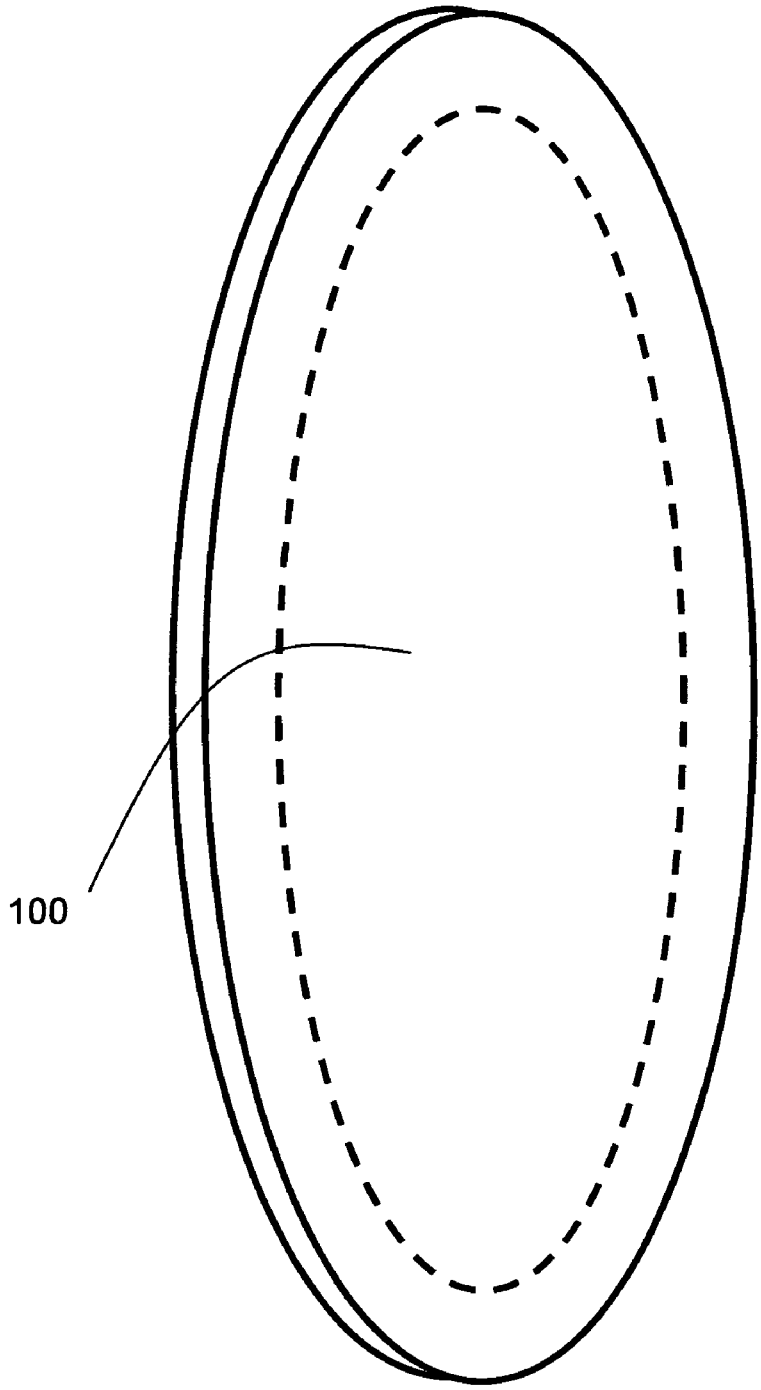
FIG. 1 illustrates a transparent surfboard using transparent foam.
Figure 2:
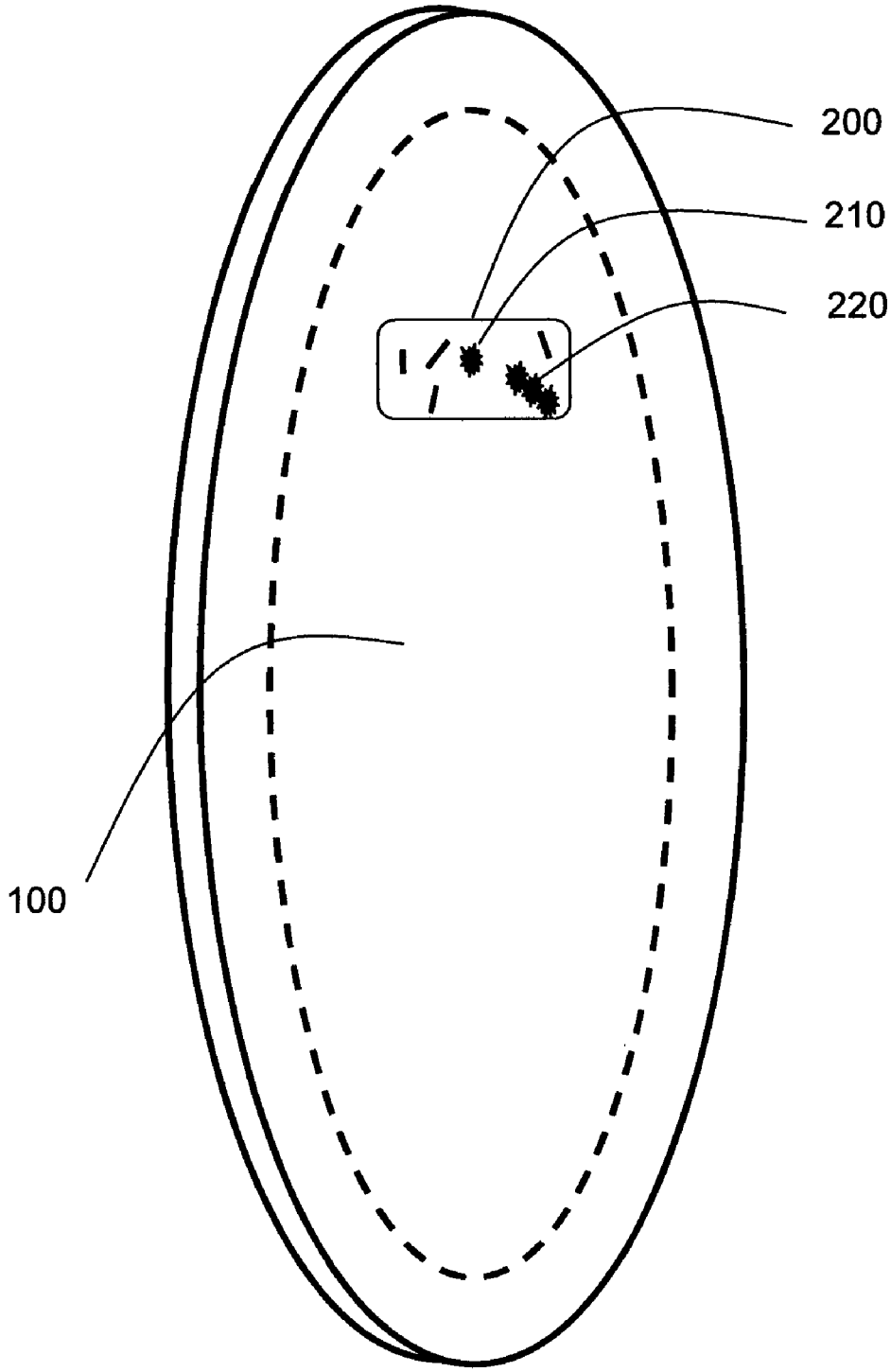
FIG. 2 illustrates a surfboard with compact locator of aquatic animals.
Figure 3:
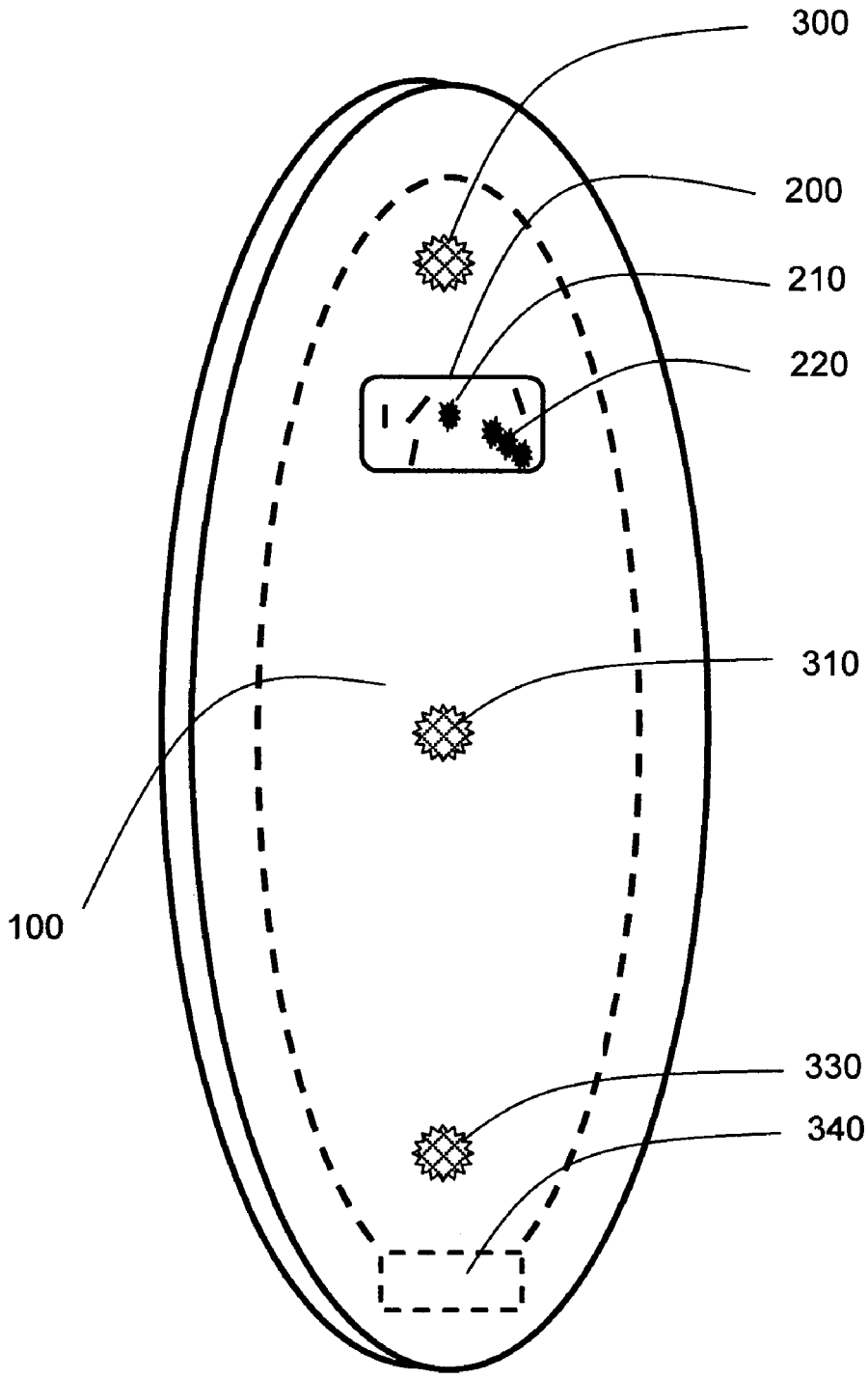
FIG. 3 illustrates a surfboard that incorporates all features of FIGS. 1 and 2 as well as the use of a signal generator and alarm for protecting the surfer from harmful predators.

The description below, in reference to FIGS. 1 through 3, is one example of the transparent surfboard or wave riding vehicle, embodying the principles and concepts of the present invention.

FIG. 1 shows a transparent surfboard representative of the invention using transparent foam. The transparent surfboard (100) is manufactured using transparent super microcellular polymer foam. The surfboard illustrated is fully transparent allowing one to see clearly through the surfboard in either direction. The foam blank forming the center or core of the surfboard is coated with clear, transparent epoxy or other transparent polymeric coating, thereby creating a fully transparent surfboard.

FIG. 2 illustrates a surfboard again representative of the invention, which may be either transparent or not, but is displayed here as transparent, with a compact locator of aquatic animals (200). The aquatic animal locator may be either embedded or surface mounted, but is shown embedded in FIG. 2. The aquatic animal locator (200), which is specifically prepared to identify such animals such as sharks, can identify aquatic animals which are about three feet in length (such as a shark) and within about a one-hundred foot radius of the surfboard (220, for example). The surfer (210) is also represented in the animal locator display (200) in order to provide the surfer with a frame of reference.

FIG. 3 illustrates a surfboard that incorporates all features of the invention from FIGS. 1 and 2 as well as the use of a signal generator (340), which may be bottom or top-mounted, but is shown here as bottom-mounted, and an alarm (300, 310, and 330 are examples of visual alarm) for protecting the surfer from harmful predators. The signal generator is configured for generating a signal pulse at a frequency of less than 1 kilohertz to disrupt the electro-sensory perception system of sharks. The alarm is configured for alerting the rider of large aquatic animals, such as sharks, that are located by the locator device. The alarm is configured for providing a visual and/or an audio warning signal to the rider.

What is claimed is:

1. A buoyant wave-riding aquatic vehicle system, comprising:

an elongate body configured for supporting a rider, the body having front and rear ends and generally flat upper and lower surfaces extending between the front and rear ends, the body being made substantially entirely of a buoyant core;

a coating disposed over and completely enclosing the elongate body;

an aquatic-animal locator device embedded within the elongate body, the locator device configured for locating large aquatic animals in proximity of the aquatic vehicle system;

an alarm device embedded within the elongate body, the alarm device configured for generating warning signal to alert the rider of the aquatic animals located by the locator device;

and an aquatic-animal repellent signal generator mounted on the elongate body, the signal generator configured for transmitting interference signals to disrupt electro-sensory perception system of the aquatic animals, thereby repelling the animals away from the aquatic vehicle system or deterring the animals from approaching the aquatic vehicle system.

2. The buoyant wave-riding aquatic vehicle system of claim 1, wherein said core comprises polymer foam.

3. The buoyant wave-riding aquatic vehicle system of claim 1, wherein said large aquatic animals are longer than three feet in length.

4. The buoyant wave-riding aquatic vehicle system of claim 1, wherein said locator device is configured to detect said aquatic animals within one hundred feet of said wave-riding aquatic vehicle system.

5. The buoyant wave-riding aquatic vehicle system of claim 1, wherein said locator device is a fish finder device that scans waters by transmitting a sonar pulse horizontally through the water.

6. The buoyant wave-riding aquatic vehicle system of claim 1, wherein the signal generator is configured for generating a signal pulse at a frequency of less than 1 kilohertz.

7. The buoyant wave-riding aquatic vehicle system of claim 1, wherein the signal generator is mounted on the lower surface of the elongate body.

8. The buoyant wave-riding aquatic vehicle system of claim 1, wherein the alarm is configured for providing at least a visual signal to the rider.

9. The buoyant wave-riding aquatic vehicle system of claim 1, wherein the alarm is configured for providing at least an audio signal to the rider.

10. The buoyant wave-riding aquatic vehicle system of claim 1, wherein the alarm is configured for providing visual and audio signals to the rider.

11. The buoyant wave-riding aquatic vehicle system of claim 1, wherein the aquatic vehicle system is a surfboard.

12. The buoyant wave-riding aquatic vehicle system of claim 1, wherein the coating is substantially transparent.

13. The buoyant wave-riding aquatic vehicle system of claim 1, wherein the coating comprises epoxy.

14. The buoyant wave-riding aquatic vehicle system of claim 1, wherein the coating comprises polymeric material.

* * * * *